United States Patent [19]

Keane et al.

[11] 3,998,442

[45] Dec. 21, 1976

[54] FURNITURE ASSEMBLY

[75] Inventors: Thomas H. Keane; Fred B. Schultz, both of Morristown, Tenn.

[73] Assignee: Lear Siegler, Inc., Santa Monica, Calif.

[22] Filed: Jan. 23, 1976

[21] Appl. No.: 651,991

[52] U.S. Cl. ..... 267/105; 5/247; 267/107

[51] Int. Cl.[2] ..... A47C 27/08; F16F 3/00

[58] Field of Search ..... 5/247, 255; 267/85–87, 267/103–107, 110; 297/454–456

[56] References Cited

UNITED STATES PATENTS

| | | | |
|---|---|---|---|
| 2,657,740 | 11/1953 | Daniels et al. | 267/105 |
| 2,764,227 | 9/1956 | Williams et al. | 267/104 |

FOREIGN PATENTS OR APPLICATIONS

| | | | |
|---|---|---|---|
| 231,989 | 12/1960 | Australia | 267/107 |

*Primary Examiner*—James C. Mitchell
*Attorney, Agent, or Firm*—Reising, Ethington, Barnard, Perry and Brooks

[57] ABSTRACT

A furniture frame construction of the disclosure includes a framework of steel frame members that support a spring assembly for a seat cushion. Front and rear frame members of the framework are fabricated from relatively thin steel stock and have closed cross-sections with projecting flanges secured to each other. End frame members of the framework are also fabricated from relatively thin steel stock with channel cross-sections and interconnect the front and rear frame members with each other. The spring assembly includes a primary spring of the formed wire type extending between the front and rear frame members. The front end of the primary spring includes a fish-mouth section that spaces a support section of this spring above the front frame member. The rear end of the primary spring includes a helical coil with a tail that supports the rear end of the support section on the rear frame member. An auxiliary spring of the spring assembly is secured to the lower side of the primary spring support section. The auxiliary spring includes transverse ends that are clipped to transverse torsion bars of the primary spring support section with a plurality of torsion bars of the support section located between the transverse ends. The auxiliary spring has an intermediate portion including an intermediate transverse torsion bar and a pair of diagonally extending legs that connect this torsion bar with the transverse ends in Z-shaped configurations. The auxiliary spring provides increased rigidity to the support section in the area where seating forces are applied. The front diagonally extending leg of the auxiliary spring is shorter than the rear diagonally extending leg and the intermediate torsion bar connecting the adjacent ends of these legs is located adjacent a torsion bar of the primary spring support section.

8 Claims, 5 Drawing Figures

FURNITURE ASSEMBLY

BACKGROUND OF THE INVENTION

1. Field of the Invention

The present invention relates to a furniture frame construction including a framework of steel frame members and an improved spring assembly utilized with the framework to provide the required seating support for seat cushion padding by incorporating a primary spring of the formed wire type and a cooperable auxiliary spring secured to the primary spring.

2. Description of the Prior Art

U.S. Pat. Nos. 3,106,389 and 3,138,373 disclose seat springs of the formed wire type. This type of spring includes transverse torsion bars and connecting portions connected to the torsion bars with generally right-angle bends. Seat springs have also included auxiliary springs that provide increased rigidity to padding supported by the springs, see for example U.S. Pat. Nos. 2,764,227 and 3,147,968. U.S. Pat. Nos. Re. 21,621, 3,210,064, and 3,334,887 disclose other seat spring constructions.

Furniture framework conventionally includes wooden frame members that are secured to each other to provide a framework for supporting seat back and seat cushion springs. The use of wooden frame members causes certain manufacturing problems. For example, tolerances are difficult to hold due to warpage, glue drying time is required to assemble a wooden framework, storing of the relatively bulky wooden frame members requires warehousing space, sawdust that is generated when the frame members are cut must be disposed of, and breakage of the wooden frame members causes rejection of completed furniture articles.

SUMMARY OF THE INVENTION

The present invention is directed to a steel furniture frame construction and an improved spring assembly for a seat cushion of the framework.

The spring assembly includes a primary spring of the formed wire type extending between front and rear frame members of the seat cushion framework. The front end of the primary spring includes a fishmouth section that spaces a support section of this spring above the front frame member. The rear end of the primary spring is mounted to the rear frame member, preferably by an integral helical coil of this spring and a tail of the coil that is secured to the rear frame member.

An auxiliary spring of the spring assembly is secured to the lower side of the primary spring support section. The auxiliary spring has transverse ends secured to transverse torsion bars of the primary spring support section. A plurality of transverse torsion bars of the support section are located between the transverse ends of the auxiliary spring and are supported by an intermediate portion of the auxiliary spring which is located immediately below the support section. The intermediate portion of the auxiliary spring includes a transverse torsion bar which is preferably located adjacent a transverse torsion bar of the support section and is connected to the transverse ends by diagonally extending legs in Z-shaped configurations. The rear diagonally extending leg is preferably longer than the forward one and these legs are arranged in an angular relationship that accommodates for a curved configuration of the primary spring support section.

The front and rear frame members that support the spring assembly are preferably fabricated from relatively thin steel stock and each preferably has a closed cross-section with outwardly projecting flanges secured to each other. End frame members of the steel framework interconnect the front and rear frame members and are also fabricated from relatively thin steel stock. These end frame members preferably have channel-shaped cross-sections.

The objects, features and advantages of the present invention will become apparent from the following detailed description of the preferred embodiment taken in connection with the accompanying drawings.

DETAILED DESCRIPTION OF THE PREFERRED EMBODIMENT

Figure 1:
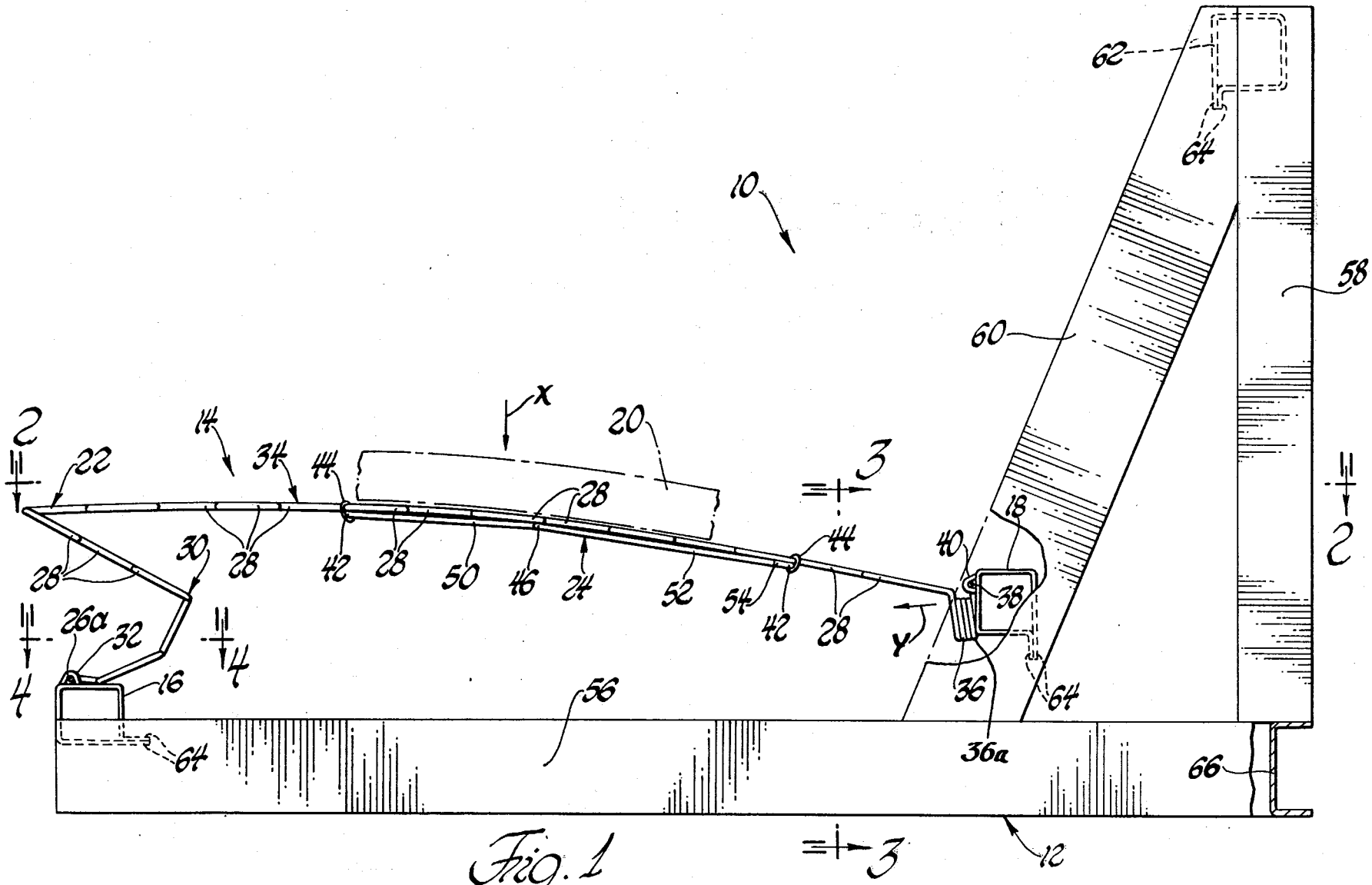
FIG. 1 is a side elevation view of a furniture frame construction and spring assembly that embody the present invention.

Referring to FIG. 1 of the drawings, a furniture frame construction embodying the present invention is collectively indicated by reference numeral 10 and includes a steel framework 12 as well as a spring assembly 14. The spring assembly extends between front and rear frame members 16 and 18, respectively, and provides support for seat cushion padding 20 upon completion of the furniture assembly. The frame members 16 and 18 extend transversely with respect to the seat cushion.

Figure 2:
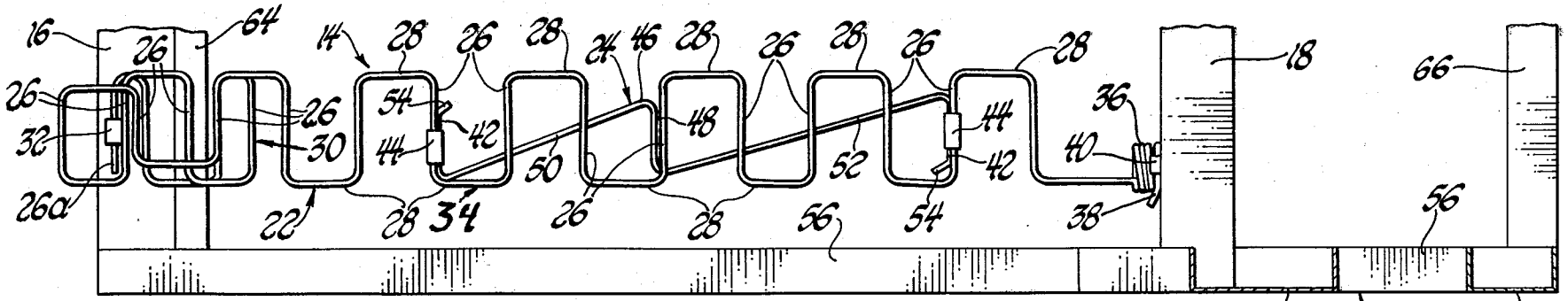
FIG. 2 is a top plane view taken partially in section along line 2—2 of FIG. 1.
Figure 5:
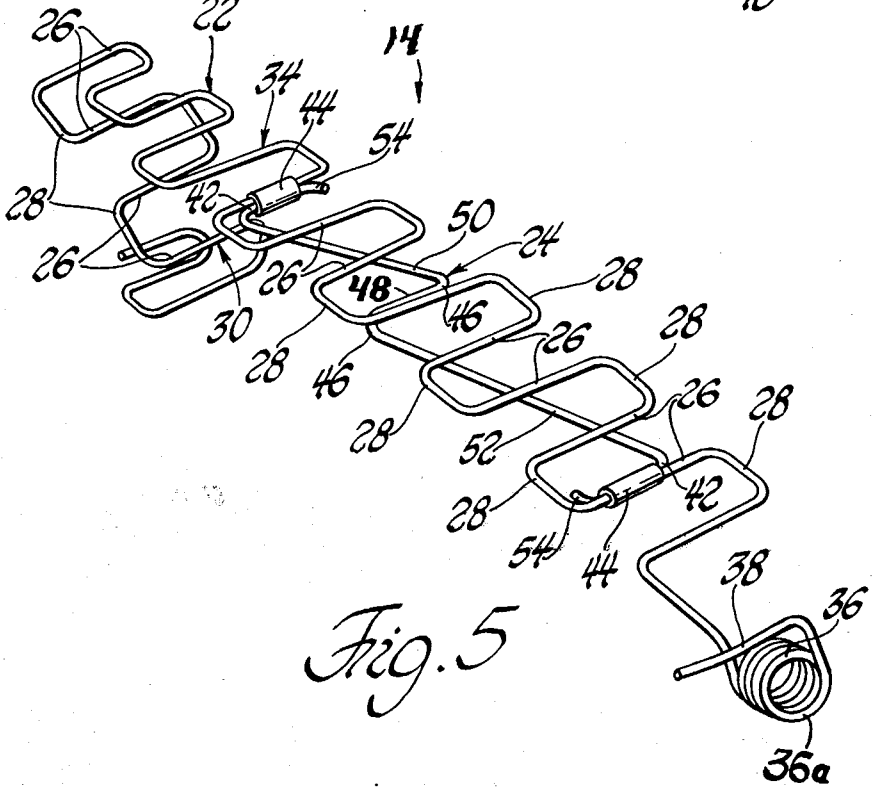
FIG. 5 is a perspective view of the spring assembly utilized with the furniture frame construction.
Figure 4:
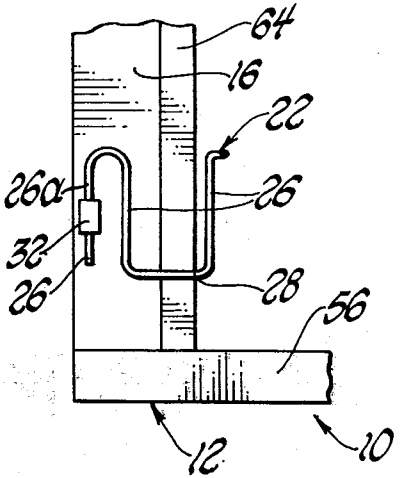
FIG. 4 is a top plan view taken along line 4—4 of FIG. 1.

With combined reference to FIGS. 1, 2 and 5, the spring assembly 14 includes a primary spring 22 and an auxiliary spring 24. The primary spring 22 is of the formed wire type having transverse torsion bars 26 which are interconnected with each other by connecting portions 28. The connecting portions 28 are joined with the torsion bars at generally right-angle bends to form the squared U-shape configurations shown, with each adjacent U-shaped configuration opening in the opposite direction to the ones on each of its sides. The forward end of the primary spring 22 includes a fishmouth section 30, FIG. 1, that opens forwardly. The lower end of the fishmouth section includes an attaching torsion bar 26*a*, FIGS. 1 and 4, that is secured by a bent tab 32 of the front frame member 16. The fishmouth section extends upwardly from the front frame member 16 and has its upper end integrally connected to the forward end of a generally horizontally extending support section 34 of the primary spring. The rear end of the support section is integrally formed with a helical coil portion 36 whose central axis extends generally horizontally in a front to rear direction. The helical coil includes a bent tail 38 which, as seen in FIGS. 1 and 2, is secured by a bent tab 40 of the rear frame member 18. The bend of tail 38 prevents it from becoming detached from the tab 40. The fishmouth section 30 and the helical coil 36 thus cooperate in supporting the support section 34 in a resilient manner. The fishmouth section maintains the forward end of the support section spaced upwardly from the front frame member 16. Between its forward and rearward ends, the support section 34 of the primary spring has a slightly curved configuration that is convex on its upper side facing the seat cushion padding 20 and concave on its lower side.

The auxiliary spring 24 is located immediately below the support section 34 of the primary spring. Transverse ends 42 of the auxiliary spring are secured to torsion bars 26 of the support section 34 by metal clips 44. The particular primary spring torsion bars 26 to which the auxiliary spring ends 42 are secured are spaced from each other with a plurality of other primary spring torsion bars located between the auxiliary spring ends. An intermediate portion 46 of the auxiliary spring extends between the transverse ends 42 and is located immediately below the torsion bars 26 between the transverse ends so as to provide support to the torsion bars. The intermediate portion 46 includes an intermediate transverse torsion bar 48, FIGS. 2 and 5, that is preferably located adjacent one of the torsion bars 26 of the primary spring. The intermediate auxiliary spring portion also includes front and rear diagonally extending legs 50 and 52, respectively, that interconnect the opposite ends of the torsion bar 48 with the front and rear transverse ends 42. The torsion bar 48 forms Z-shaped configurations with each of the diagonally extending legs and its associated transverse end 42 as best seen in FIG. 2. Each transverse end 42 of the auxiliary spring includes a hook 54 located on the opposite side of the associated clip 44 from the location where the adjacent diagonally extending leg is integrally joined to the transverse end. These hooks prevent the auxiliary spring from shifting and becoming detached from the primary spring.

The auxiliary spring 24 cooperates with the primary spring 22 to provide a spring assembly that can bridge the gap between the front and rear frame members 16 and 18 and still provide the required support for seat cushion padding. The assembly of the auxiliary and primary springs enables this padding support to be accomplished with a relatively small gauge wire forming each spring even with the relatively long front-to-rear distance of furniture seat cushion constructions. Also, as seen in FIG. 1, the front and rear legs 50 and 52 of the auxiliary spring are located in an angular relationship that accommodates for the curved configuration of the primary spring support section 34. The auxiliary spring bends at its intermediate torsion bar 48 at the juncture of these legs, and the front leg 50 is slightly shorter than the longer rear leg 52 so that the resiliency of the auxiliary spring is at the proper location so as to provide the proper support to the seat cushion padding.

A single spring assembly 14 extending between the front and rear frame members is shown in the drawings; but, it should be understood that a plurality of such spring assemblies would be utilized in a completed piece of furniture. These spring assemblies would be spaced laterally with respect to each other extending forwardly and rearwardly between the front and rear frame members to provide the proper support for seat cushion padding along the total width of the piece of furniture.

Figure 3:
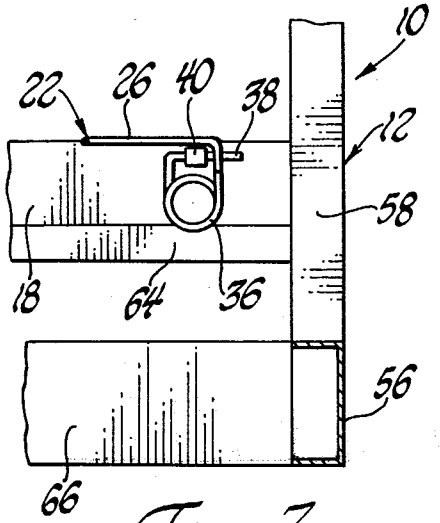
FIG. 3 is a sectional view through the frame construction and spring assembly looking rearwardly along line 3—3 of FIG. 1.

As seen in FIG. 1, the steel framework 12 of the furniture frame construction includes a horizontal end member 56, a vertical end member 58, and an angular end member 60. The front end of the end member 56 is welded to the adjacent end of the front frame member 16 and the lower end of the end member 60 is welded to the rear frame member 18. The end member 58 has its lower end welded to the rear end of end member 56 and has its upper end welded to the upper end of end member 60. The upper ends of end members 58 and 60 are welded to an upper frame member 62 that provides support for seat back springs, not shown, of the furniture construction. The end members 56, 58 and 60 are located at each end of the frame members 16, 18 and 62 to cooperatively provide the steel framework for the frame construction. Also, a transverse frame member 66 is welded to the rear ends of the end members 56 at each lateral side of the furniture construction. Each frame member 16, 18 and 62 has a closed cross-section that is fabricated from relatively thin steel stock into a hollow square configuration with projecting flanges 64 that are welded to each other. The end members 56, 58 and 60 and the frame member 66 are also fabricated from relatively thin steel stock but define channel-shaped cross-sections as seen in FIGS. 1, 2 and 3. The construction of the steel framework 12 eliminates the necessity of wooden frame members utilized in conventional furniture and the accompanying manufacturing costs associated with such wooden frame members.

When the spring assembly 14 is installed by securing the bar 26a and the tail 38 to the frame members 16 and 18, it is placed in tension; the spacing between tabs 32 and 40 is greater than the spacing between bar **26*a* and tail 38 in the unstressed condition of the spring assembly 14.**

Reference character **36*a* indicates the rear, outer coil of the helical portion 36. The lower portion of coil 36*a* bears against the lower edge of frame member 18 as shown in FIG. 1. Hence, when a force is applied to the spring assembly 14 in the direction of arrow X in FIG. 1, the helical portion 36 is restrained such that the upper portion thereof tends to stretch in the direction of arrow Y. Stated another way, the upper portions of the coils of the helical portion 36 tend to resiliently separate while the lower portions tend to press against each other and the frame member 18. Therefore, the desired resilient properties of the spring assembly 14 result not only from the construction of the spring assembly but from the manner in which the spring assembly is mounted onto the frame members 16 and 18.**

While a specific form of the invention has been illustrated in the accompanying drawings and described in the foregoing specification, it should be understood that the invention is not limited to the exact construction shown. To the contrary, various alterations in the construction and arrangement of parts, all falling within the scope and spirit of the invention, will be apparent to those skilled in the art.

What is claimed is:

1. A furniture spring assembly comprising: a primary spring for providing support between spaced front and rear frame members of a furniture seat cushion, said primary spring being of the formed wire type including transversely extending torsion bars and connecting portions connected with the torsion bars at generally right-angle bends, the primary spring including front and rear ends adapted for mounting on the front and rear frame members and a support section extending between the front and rear ends to provide support for seat cushion padding, and the front end of the primary spring including a fishmouth section that spaces the support section above the front frame member; and an auxiliary spring for the support section of the primary spring, the auxiliary spring including transverse ends secured to torsion bars of the support section which are spaced from each other with a plurality of torsion bars of the support section therebetween, the auxiliary spring including an intermediate portion extending between the transverse ends thereof immediately below the support section of the primary spring so as to provide support to the support section torsion bars located between the transverse ends, and the intermediate portion of the auxiliary spring including a transverse torsion bar located immediately below the support section of the primary spring to provide support thereto and a location where bending takes place and also including front and rear legs that connect the transverse ends with the transverse torsion bar in a Z-shaped fashion.

2. A spring assembly as in claim 1 which includes a pair of clips securing the transverse ends of the auxiliary spring to the support section of the primary spring, and the transverse ends including hooks on the opposite side of the adjacent clip from the adjacent diagonally extending leg of the intermediate portion of the auxiliary spring.

3. A spring assembly as in claim 1 wherein the torsion bar of the auxiliary spring is located adjacent a torsion bar of the primary spring.

4. A spring assembly as in claim 3 wherein the rear diagonally extending leg of the auxiliary spring is longer than the front diagonally extending leg of the auxiliary spring.

5. A spring assembly as in claim 1 wherein the support section of the primary spring has a curved configuration that is concave on its lower side, and the diagonally extending legs being arranged in an angular relationship to accommodate for the curvature of the support section.

6. A furniture spring assembly comprising: a primary spring for providing support between spaced front and rear frame members of a furniture seat cushion, said primary spring being of the formed wire type including transversely extending torsion bars and connecting portions connected with the torsion bars at generally right angle bends, the primary spring including front and rear ends adapted for mounting on the front and rear frame members and a support section extending between the front and rear ends to provide support for seat cushion padding, the front end of the primary spring including a fishmouth section that spaces the support section above the front frame member, the rear end including a helical coil having a central axis that extends generally horizontally in a front-to-rear direction, and a tail of the helical coil that provides the mounting of the rear end on the rear frame member; and an auxiliary spring for the support section of the primary spring, the auxiliary spring including transverse ends associated with torsion bars of the support section which are spaced from each other with a plurality of torsion bars of the support section therebetween, a pair of clips for securing the transverse ends to the associated torsion bars of the support section, the auxiliary spring including an intermediate portion connecting the transverse ends thereof, the intermediate portion having an intermediate transverse torsion bar and a pair of diagonally extending legs connecting the intermediate torsion bar with the transverse ends in Z-shaped configurations immediately below the support section of the primary spring so as to support the torsion bars thereof located between the transverse ends, the intermediate torsion bar of the primary spring, and the diagonally extending leg adjacent the rear end of the primary spring being longer than the one adjacent the forward end of the primary spring.

7. A furniture frame construction comprising: a steel framework including interconnected frame members fabricated from relatively thin steel stock, the frame members of the framework including a front frame member for a seat cushion of the frame construction and a rear frame member for the seat cushion, the front and rear frame members extending transversely with respect to the seat cushion, and end frame members for interconnecting the front and rear frame members; at least one primary spring for providing support between the front and rear frame members, said primary spring being of the formed wire type including transversely extending torsion bars and connecting portions connected with the torsion bars at generally right angle bends, the primary spring including front and rear ends mounted on the front and rear frame members and a support section extending between the front and rear ends to provide support for seat cushion padding, the front end including a fishmouth section that spaces the support section above the front frame member; and an auxiliary spring for the support section of the primary spring, the auxiliary spring including transverse ends secured to torsion bars of the support section which are spaced from each other with a plurality of torsion bars of the support section therebetween, the auxiliary spring including an intermediate portion extending between the transverse ends thereof immediately below the support section of the primary spring so as to provide support to the support section torsion bars located between the transverse ends, and the intermediate portion of the auxiliary spring including a transverse torsion bar where the auxiliary spring bends upon loading and also including front and rear diagonally extending legs that connect the transverse ends with the transverse torsion bar in a Z-shaped fashion.

8. A construction as in claim 7 wherein the front and rear frame members each have a closed cross-section and outwardly projecting flanges secured to each other and wherein the end frame members have channel-shaped cross-sections.

* * * * *